US006293524B1

(12) United States Patent
Endo et al.

(10) Patent No.: US 6,293,524 B1
(45) Date of Patent: Sep. 25, 2001

(54) CARBURETOR WITH ACCELERATING DEVICE

(75) Inventors: Masatoshi Endo; Noriyuu Nagata, both of Miyagi (JP)

(73) Assignee: Walbro Japan, Inc., Cass City, MI (US)

( * ) Notice: Subject to any disclaimer, the term of this patent is extended or adjusted under 35 U.S.C. 154(b) by 0 days.

(21) Appl. No.: 09/487,982

(22) Filed: Jan. 20, 2000

(30) Foreign Application Priority Data

Feb. 1, 1999 (JP) ..... 11-023917

(51) Int. Cl.[7] ..... F02M 7/08
(52) U.S. Cl. ..... 261/34.2; 261/51
(58) Field of Search ..... 261/34.2, 34.1, 261/35, 51, 52

(56) References Cited

U.S. PATENT DOCUMENTS

| | | | | |
|---|---|---|---|---|
| 2,080,569 | * | 5/1937 | Holley | 261/34.2 X |
| 2,182,393 | * | 12/1939 | Ball et al. | 261/34.2 |
| 2,190,314 | * | 2/1940 | Firth | 261/34.2 |
| 2,214,273 | * | 9/1940 | Fish | 261/34.2 |
| 2,223,987 | * | 12/1940 | Firth | 261/34.2 |
| 2,478,613 | * | 8/1949 | Weber | 261/34.2 X |
| 2,989,292 | * | 6/1961 | Marsee | 261/34.2 |
| 3,730,495 | * | 5/1973 | Elam | 261/34.2 |
| 5,250,233 | | 10/1993 | Swanson | 261/34.2 |
| 5,554,322 | | 9/1996 | Kobayashi | 261/35 |
| 5,611,312 | | 3/1997 | Swanson et al. | 261/52 X |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A carburetor for an internal combustion engine with an accelerator fuel pump in the carburetor having a piston actuated by a cam on a throttle valve shaft and a ball between them. The axis of a pump chamber in which the piston is slidably received is offset from and eccentric to the axis of rotation of the throttle shaft so that little fuel is supplied to the operating engine by the accelerator pump as the shaft is rotated to move the throttle valve from its idle position to an intermediate position and most of the fuel supplied by the accelerator pump to the engine is delivered as the shaft is rotated to move the throttle valve from the intermediate position to its wide open throttle position. This provides a proper fuel mixture to the engine to accelerate it and avoids the problem of supplying an overly rich fuel mixture to the engine during acceleration and particularly if the operator moves the throttle valve several times back and forth between the idle and intermediate positions before moving the throttle valve to the wide open position to accelerate the engine.

9 Claims, 3 Drawing Sheets

CARBURETOR WITH ACCELERATING DEVICE

REFERENCE TO RELATED APPLICATION

Applicants claim the priority of Japanese patent application, Ser. No. 11-023917, filed Feb. 1, 1999.

FIELD OF THE INVENTION

This invention relates to carburetors for internal combustion engines and more particularly to an accelerator pump of the carburetor.

BACKGROUND OF THE INVENTION

Some carburetors for gasoline fueled small engines such as two-stroke engines for handheld power tools such as chain saws, weed trimmers, leaf blowers and the like have carburetors with an internal accelerator pump which supplies additional fuel to the operating engine as the throttle valve of the carburetor is opened from its essentially closed or idle position toward its completely wide open throttle position. This additional fuel is needed to smoothly and rapidly accelerate the engine without stumbling particularly when it is under a load. Many prior accelerator devices have a positive displacement pump with a piston actuated by rotation of a shaft of a throttle valve through a wide variety of mechanical cam and linkage arrangements. One problem with these positive displacement accelerator pumps is they supply an excess quantity of fuel producing an overly rich fuel mixture for the engine upon initial opening of the throttle from its idle position and particularly if the throttle is opened or advanced to only an intermediate position which is less than the wide open throttle position. This is particularly a problem with a handheld power tool because many operators tend to rather rapidly partially open and close the throttle several times before fully opening and maintaining the throttle at its wide open position for a period of time during which a power tool is in actual use and its engine is under a substantial load.

SUMMARY OF THE INVENTION

In a carburetor with a shaft rotatable to move a throttle valve in a fuel and air mixing passage between an essentially closed or idle position and a fully open or wide open throttle position, an accelerator pump which delivers most of the accelerating fuel only after the throttle has been partially opened to an intermediate position and is then further advanced toward its wide open position so that an excessively rich fuel mixture is not provided for accelerating the engine. Preferably, the accelerator pump has a piston slidably received in a cylinder bore and movable to an advanced position to dispense a quantity of accelerating fuel and to a retracted position to refill the cylinder with fuel. In response to rotation of the throttle shaft to move the throttle valve from its idle to its wide open position, the piston is advanced by a cam which is preferably a face on the throttle shaft engaging a ball received in the bore between the piston and the shaft. So that the extent to which the piston is advanced is small as to throttle valve and shaft are moved from the idle position to an intermediate position and the extent of travel is significantly greater as the shaft and throttle are further advanced from the intermediate position to the wide open throttle position, the axis of the cylinder bore and hence the piston and the path of travel of the center of the ball are all eccentric to or offset and spaced from the axis of rotation of the throttle shaft so that these axes do not intersect.

Preferably, these axes are at right angle to each other and the piston is yieldably biased toward its retracted position and into engagement with the ball and the ball into engagement with the cam by a spring or other biasing means.

OBJECTS, FEATURES AND ADVANTAGES OF THIS INVENTION

Objects, features and advantages of this invention include providing a carburetor with an accelerator pump in which most of the accelerating fuel is delivered only as the throttle valve and shaft is advanced from an intermediate position toward its wide open position, supplies only sufficient fuel for accelerating an operating engine without providing an overly rich fuel mixture for acceleration, does not provide an overrich fuel mixture even when an operator rapidly moves the throttle valve between its idle and intermediate positions several times, is rugged, durable, reliable, of relatively simple design and economical manufacture and assembly and in service has a long useful life without any maintenance or repair.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION

Figure 1:
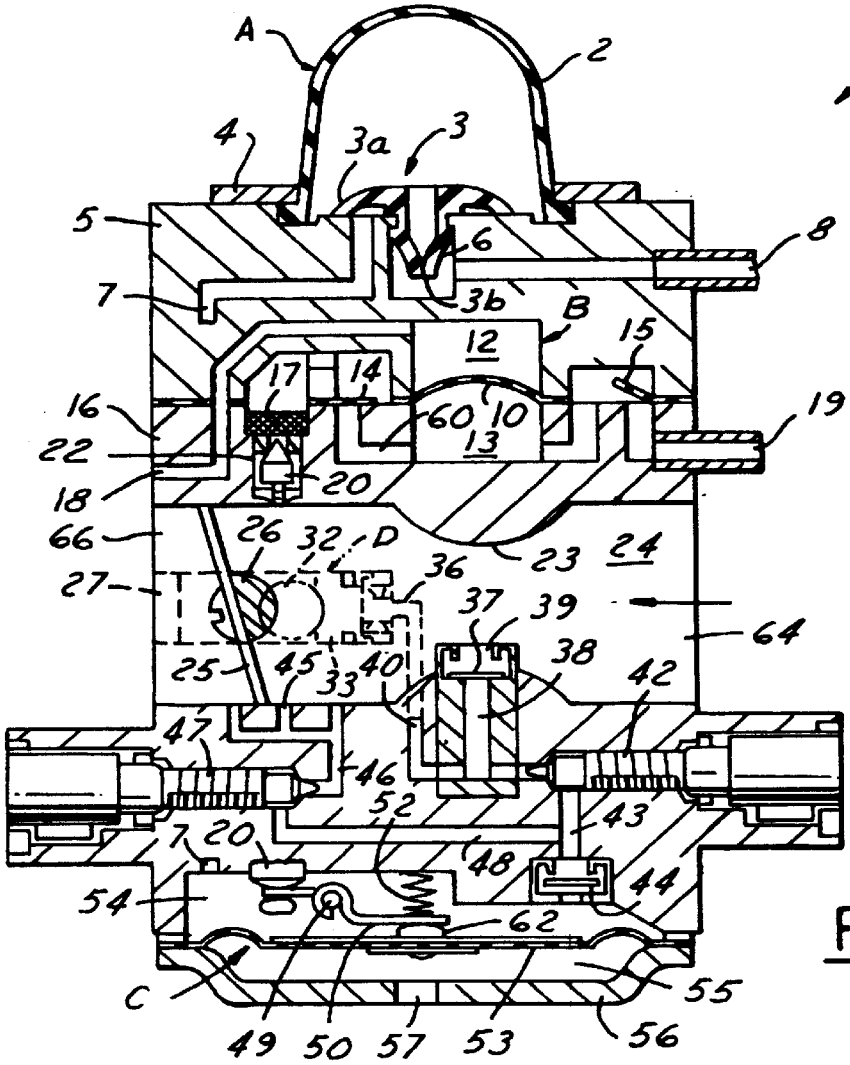
FIG. 1 is a full sectional view of a diaphragm carburetor with a first embodiment of an accelerator pump of this invention.

Referring in more detail to the drawings, FIG. 1 illustrates a diaphragm type carburetor 1 for an internal combustion gasoline fueled engine with an accelerator pump D embodying this invention. The diaphragm carburetor 1 also has a manual primer pump assembly A, a fuel supply pump assembly B, and a fuel metering system C each of which, if desired, may be of conventional construction.

When the engine is operating, the fuel pump assembly B supplies fuel to the metering system C of the carburetor. The fuel pump B has a flexible diaphragm or membrane 10 received and sealed between an upper face of the carburetor body 16 and a lower face of an upper cover 5 and defining in part a fuel pump chamber 13 and a pulse chamber 12 to which pressure and vacuum pulses in the crankcase of a two-cycle operating engine are introduced through a passage 18 to flex or actuate the diaphragm 10. Flexing of the diaphragm 10 draws fuel from a fuel tank (not shown) through inlet passage 19 and a one-way check valve 15 into the pump chamber 13 and supplies the fuel under pressure through an outlet passage 60, one-way check valve 14 and a screen 17 to the fuel metering system C through its flow control valve 20.

The fuel metering system C has a flexible diaphragm or membrane 53 received and sealed between a lower face of the carburetor body and a lower cover 56 to define a fuel chamber 54 on one side of the diaphragm and an atmospheric air chamber 55 on the other side of the diaphragm which communicates with the atmosphere exteriorly of the carburetor through a port 57 in the lower cover. The flow valve 20 is opened and closed to control the admission of fuel to chamber 54 by movement of the diaphragm which is operably connected to the valve by a lever 50 connected adjacent one end to the valve 20 and adjacent the other end bears on a projection 62 attached to the center of the diaphragm and between its ends is pivotally mounted on a support shaft 49. The valve 20 is yieldably biased to its closed position by a spring 52 bearing on the lever 50.

The carburetor has an air and fuel mixing passage 24 with an air inlet 62, a restricted venturi section 23 downstream of the inlet, usually a choke valve (not shown) between them, and downstream of the venturi an outlet 66 which communicates with an intake passage of the engine. A throttle valve 25 is received in the mixing passage downstream of the venturi and is mounted on a throttle shaft 26 extending transversely through the passage and journalled for rotation in the body 16.

In operation of the carburetor, fuel is supplied from the metering chamber 54 to a high speed fuel nozzle 39 opening into the mixing passage 24 via a check valve 44, passage 43, adjustable fuel regulating needle valve 42, passage 38, and check valve 37. Fuel is also supplied to a series of low speed fuel nozzles or ports 45 which open into the mixing passage 24 both upstream and downstream of the throttle valve in its idle or closed position, via a branch passage 48, adjustable low speed fuel regulating needle valve 47 and passage 46. In operation, air flowing through the mixing passage 24 creates a pressure differential causing fuel to flow through the low speed nozzle 45 downstream of the throttle valve 25 (in its idle position) into the mixing passage and in the engine under idle and near idle operating conditions and to flow through the high speed nozzle 39 into the mixing passage 24 and the engine when the engine is in the range from near idle to wide open throttle operating conditions. This pressure differential acts on the diaphragm 53 to open and close the valve 20 to maintain a predetermined quantity of fuel in the metering chamber 54 and at a substantially constant pressure when the engine is operating to supply fuel to the low and high speed nozzles.

When the engine is not operating and in preparation for starting it, a primer pump A may be manually actuated to expel any air and/or fuel vapor from the fuel chamber 54 before starting the engine. The primer pump has a flexible rubber dome or syringe 2 attached and sealed to the upper cover 5 by a retainer plate 4 and enclosing a complex mushroom shaped valve 3 with a suction or inlet valve 3*a* communicating through a passage 7 with an upper portion of the fuel metering chamber 54 and an outlet or discharge valve 3*b* communicating through a passage 8 with an upper portion of the fuel tank. The primer pump A is actuated by manually repeatedly alternately pressing down or collapsing and releasing the dome. When the collapsed dome is released, air and fuel vapor in the fuel chamber flow through the passage 7 and the valve 3*a* and enters the dome 2 and, as the dome is pressed or collapsed, the air and fuel vapor therein flows through the valve 3*b* and passage 8 and is discharged into the fuel tank.

Figure 2:
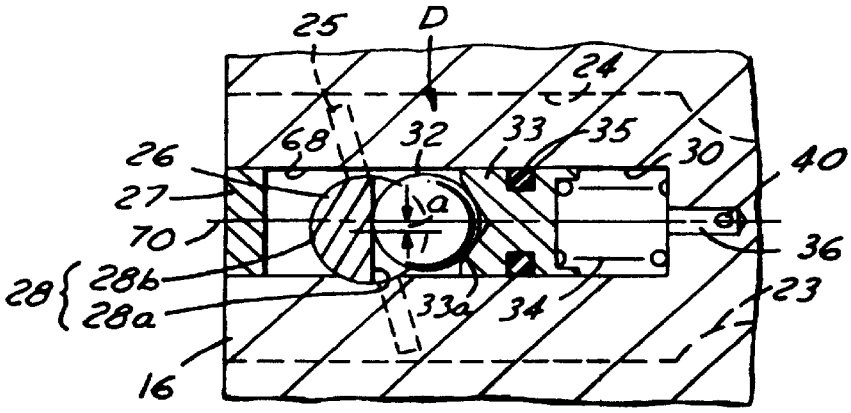
FIG. 2 is a fragmentary sectional side view of the accelerator pump of FIG. 1 with the throttle valve and shaft shown in their idle position.
Figure 3:
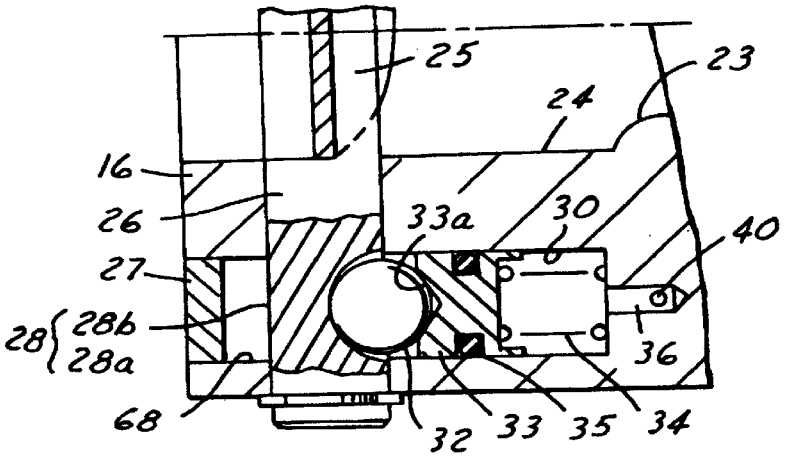
FIG. 3 is a fragmentary sectional plan view of the accelerator pump of FIG. 1 taken at a right angle to the sectional view of FIG. 2 with the throttle valve and shaft shown in their idle position.
Figure 4:
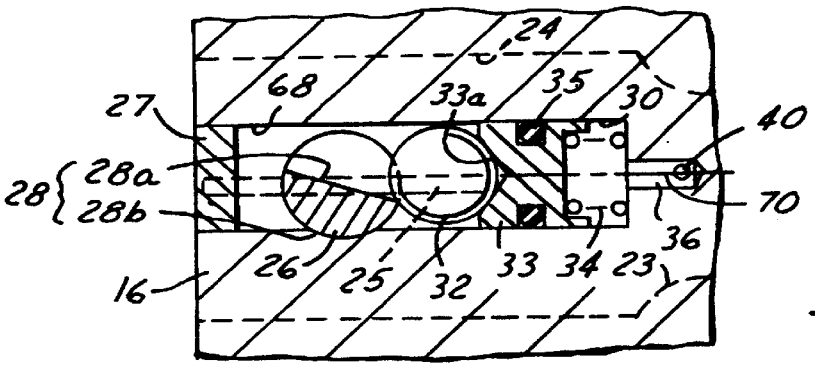
FIG. 4 is a fragmentary sectional side view of the accelerator pump of FIG. 1 with the component parts shown in the position they assume when the throttle valve and shaft are in their wide open throttle position.

As shown in FIGS. 1–3, in accordance with this invention, preferably the accelerator device D is provided inside the carburetor body adjacent the throttle shaft 26 in an area spaced or remote from or outside of the mixing passage 24. The accelerator pump D has a piston 33 slidably received in a blind bore 68 forming a pump cylinder or chamber 30 which communicates through passages 36 and 40 with both the high speed fuel nozzle 39 and the metering chamber 54 through the needle valve 42, passage 43 and check valve 44. Preferably, the other end of the bore 68 is closed by a plug 27 press fit therein. In use, the piston is actuated by a cam 28 on the throttle shaft which engages a spherical ball 32 disposed between them and received in a recess 33*a* in an end of the piston. Preferably, the recess 33*a* has a conical or spherical shape to retain the center of the ball 32 coincident with the axis 70 of the piston 33 and the bore 68. A seal is provided between the piston and the bore by an O-ring 35 and the piston 33 is yieldably biased towards its retracted position and into engagement with the ball 32 which in turn is urged into engagement with the cam 28 by a spring 34 received in the chamber 30 and bearing on the piston. Preferably, the cam 28 consists of a cut-away face 28*a* and a peripheral face 28*b* of the throttle shaft. As shown in FIG. 3, preferably the face 28*a* is a cylindrical surface with an axis which is perpendicular to the axis of the throttle shaft and a radius which is larger than the radius of the ball 32.

Figure 5:
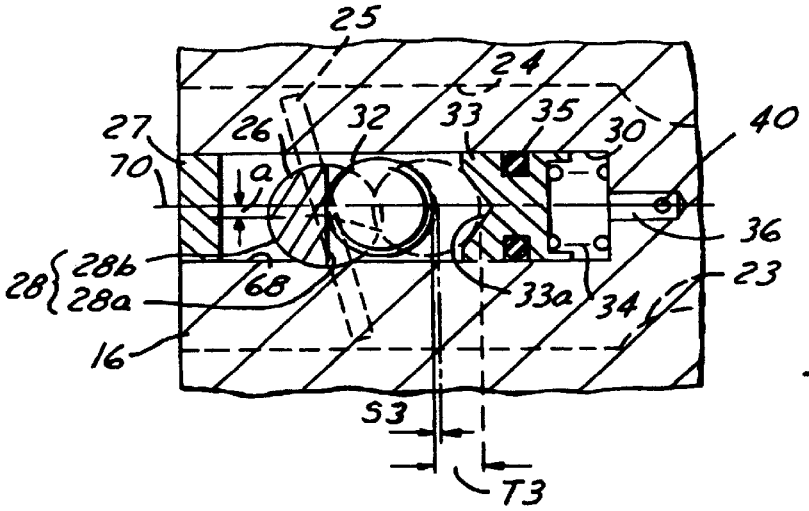
FIG. 5 is a fragmentary sectional side view of the accelerator pump of FIG. 1 with the throttle shaft and ball shown in solid line in the throttle valve idle position, in chain line in the throttle valve intermediate position, and in dashed line in the wide open throttle valve position.
Figure 6:
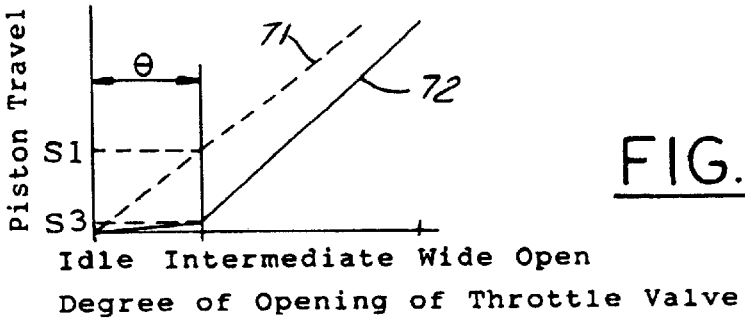
FIG. 6 is a graph showing in solid line the extent of advancement of the piston of the accelerator pump of FIG. 1 as a function of the extent of rotation of the throttle shaft and valve from their idle position to their wide open throttle position and in dashed line the extent of advancement of a piston of a prior art accelerator pump as a function of the extent of rotation of its throttle shaft and valve from their idle position to their wide open throttle position.

In accordance with the invention, as shown in FIGS. 2 and 5, the axis 70 of the pump cylinder 30 is offset and spaced from or located eccentrically with respect to the axis of rotation of the throttle valve shaft 26 by a distance a so that upon initial rotation of the throttle valve from its idle position to an intermediate position the displacement of the ball 32 and piston 33 is very small and most of the displacement of the ball and piston occurs as the throttle valve is further rotated from its intermediate position toward and to its wide open throttle position. In FIG. 5, the intermediate position where the throttle valve 25 has been rotated from its idle position about 30° counterclockwise is shown by a chain line and the position where the throttle valve has been rotated from its idle position about 75° to its fully open or wide open throttle position is shown by a dashed line. It is apparent that the amount of travel or displacement S3 of the piston 33 when the throttle valve 25 is rotated from its idle position to the intermediate position is very small compared to the amount of travel or displacement T3 of the piston when the throttle valve is rotated from its idle position to its wide open throttle position. As indicated by the solid line 72 in the graph of FIG. 6, with this accelerator pump D, the amount of advancement or travel S3 of the piston from the idle position to the intermediate position of 30° of rotation θ of the throttle valve 25 is very small compared to the amount of advancement or travel S1 of the piston of a conventional prior art accelerator pump as indicated by the dashed line 71. Accordingly, compared to prior art devices, the accelerator pump D will deliver little fuel when the throttle is advanced to the intermediate position and thus will not supply an overly rich fuel mixture to the engine.

Figure 7:
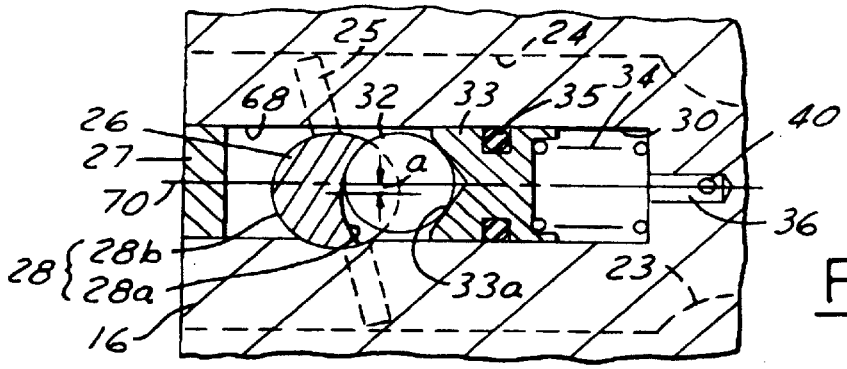
FIG. 7 is a fragmentary sectional side view of a modified fuel pump of this invention in the carburetor of FIG. 1 with the throttle valve and shaft shown in their idle position.
Figure 8:
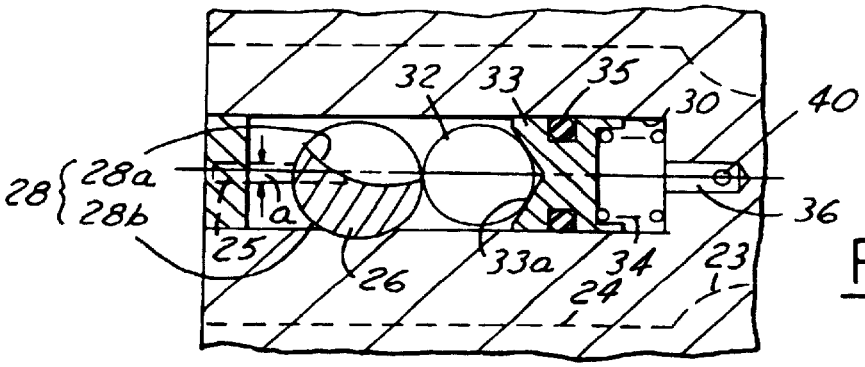
FIG. 8 is a fragmentary sectional side view of the accelerator pump of FIG. 7 with the throttle shaft, ball and piston shown in their respective positions when the throttle shaft and valve are in their wide open throttle position.
Figure 9:
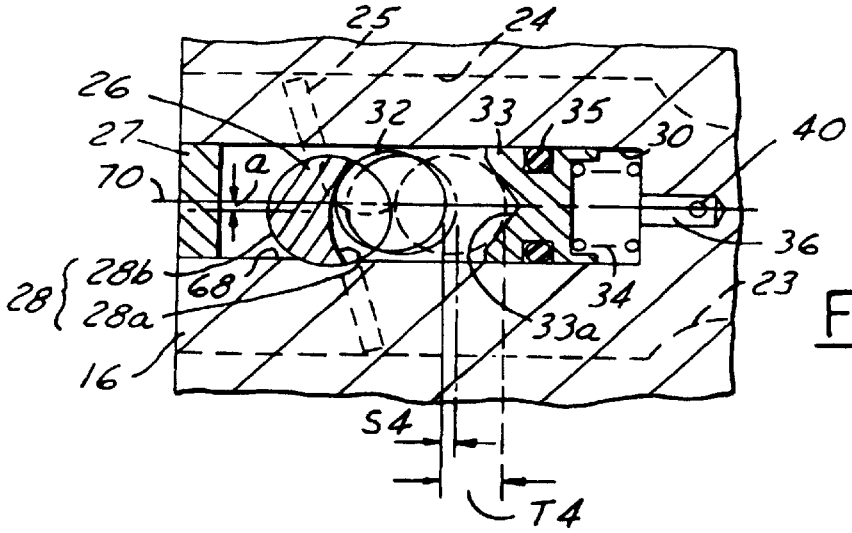
FIG. 9 is a fragmentary sectional side view of the accelerator pump of FIG. 7 with the throttle shaft and ball shown in solid line in the throttle valve idle position, in chain line in the throttle valve intermediate position, and in dashed line in the throttle valve wide open throttle position.

A modification of the accelerator pump D is illustrated in FIGS. 7–9 in which the cut-away cam face 28*a* is a semi-spherical surface and the other components are the same as those of the first embodiment of FIGS. 2–5. As will be apparent to skilled persons, the cam face 28*a* may also have other configurations such as an arcuate surface with radii or a cylindrical surface with a radius larger than the radius of the ball. The axis of the cylindrical surface may be substantially parallel to the axis of the throttle shaft. As shown in FIG. 9, with these modifications, the amount of displacement or travel S4 of the piston 33 when the throttle valve 25 is rotated 30° counterclockwise from its idle position to its intermediate position is also small compared with the amount of advancement or travel S1 of the piston of a prior art accelerator pump and relative to the total displacement or travel T4 of the piston with these modifications when the throttle valve is rotated 75° counterclockwise from its idle position to its wide open throttle position. In FIG. 9, the position of the throttle shaft 26 and ball 32 when the throttle valve 25 is in its idle position is shown in solid line, when the throttle valve is in its intermediate position is shown in chain line, and when the throttle valve is in its wide open throttle position is shown in dashed line. Thus, rotation of the throttle valve from its idle position to its intermediate position causes the accelerator pump to supply only a very small quantity of fuel so that an overly rich fuel mixture is not supplied to the engine.

In use of the carburetor on an operating engine, in all embodiments of the accelerator pump, as the operator initially advances the throttle valve from its idle position to its intermediate position, the piston 33 is advanced only a small amount and thus the pump delivers only a small quantity of additional fuel to the operating engine so that it does not receive an overly rich mixture and when the throttle valve is further opened from its intermediate position toward its wide open throttle position, the cam and ball arrangement advances the piston 33 a comparatively large amount to discharge a relatively larger quantity of fuel from the pump chamber and through the high speed fuel nozzle 39 into the mixing passage to provide an enriched fuel mixture to accelerate the operating engine. As the throttle shaft 26 is rotated to move the throttle valve from its idle position to its wide open throttle position, preferably the contact point of the ball 32 with the cam face 28*a* moves from one side of the face 28*a* through the center of the face and toward the edge of the face or toward the peripheral face 28*b* of the cam.

When the throttle is moved from its wide open position toward its idle position, the spring 34 moves the piston 33 toward its retracted position which draws fuel from the metering chamber 54 into the pump chamber 30 through the interconnecting passages to refill the accelerator pump chamber with fuel. Even if the operator repeatedly opens and closes the throttle valve between its idle and intermediate positions, the accelerator pump will supply relatively little fuel to the engine and thus the fuel mixture supplied to the engine will not be too rich. Thus, as frequently occurs, the operator rapidly and repeatedly "snapping" the throttle partially open and closed, as a prelude to moving the throttle to its wide open position to accelerate the engine will not adversely affect engine performance and acceleration.

What is claimed is:

1. A carburetor comprising:

a body, a mixing passage through the body, a throttle valve shaft carried by the body and extending transversely through the mixing passage, a throttle valve in the mixing passage, connected to the throttle valve shaft and movable by rotation of the shaft between an idle position in which the throttle valve substantially closes the mixing passage and a wide open throttle position of the valve, and movable to and through an intermediate position of the throttle valve between the idle position and the wide open throttle position, a fuel chamber carried by the body, a bore in the body with its axis offset from and not intersecting the axis of the throttle valve shaft, an accelerator pump piston slidably received in the bore and defining in cooperation with the bore a pump chamber communicating with the fuel chamber to receive fuel from the fuel chamber when the piston moves in one direction, and communicating with the mixing passage to deliver fuel from the pump chamber into the mixing passage when the piston moves in the other direction, a cam connected with the throttle valve shaft for movement in unison with rotation of the throttle valve shaft, a ball received between and bearing on the cam and the piston so that rotation of the throttle valve shaft to move the throttle valve from the idle position to the wide open throttle position moves the piston to deliver a quantity of fuel from the pump chamber into the mixing passage to accelerate the operating engine with most of the fuel being delivered from the pump chamber only as the throttle valve is moved from an intermediate position to the wide open throttle position.

2. The carburetor of claim 1 wherein the cam comprises a cut-away face in the throttle valve shaft.

3. The carburetor of claim 1 wherein the cam comprises a cylindrical face in the throttle valve shaft with its axis extending generally transversely of the axis of the throttle valve shaft and the cylindrical face has a radius which is larger than the radius of the ball.

4. The carburetor of claim 1 wherein the cam comprises a spherical face in the throttle valve shaft and the spherical face has a radius larger than the radius of the ball.

5. The carburetor of claim 1 wherein the cam comprises an arcuate face in the throttle valve shaft and the arcuate face is larger than the radius of the ball.

6. The carburetor of claim 1 which also comprises a spring yieldably biasing the piston to bear on the ball and the ball to bear on the cam.

7. The carburetor of claim 1 which also comprises a spring received in the pump chamber and yieldably biasing the piston to bear on the ball and the ball to bear on the cam.

8. The carburetor of claim 1 wherein a portion of the throttle valve shaft extends generally transversely across the bore and the cam is received at least in part in the bore.

9. The carburetor of claim 1 wherein the axis of the throttle valve shaft extends generally transversely of the axis of the bore, a portion of the throttle valve shaft extends across the bore, and the cam is at least in part received in the bore.

* * * * *